US006565675B1

(12) United States Patent
Mitsui

(10) Patent No.: US 6,565,675 B1
(45) Date of Patent: May 20, 2003

(54) STEEL WIRE AND METHOD OF PRODUCING THE SAME AND PNEUMATIC TIRE USING THE SAME

(75) Inventor: Kentaro Mitsui, Kuroiso (JP)

(73) Assignee: Bridgestone Corporation, Tokyo (JP)

( * ) Notice: Subject to any disclaimer, the term of this patent is extended or adjusted under 35 U.S.C. 154(b) by 96 days.

(21) Appl. No.: 09/637,937

(22) Filed: Aug. 14, 2000

(30) Foreign Application Priority Data

Aug. 12, 1999 (JP) ..... 11-228229
Sep. 9, 1999 (JP) ..... 11-255281

(51) Int. Cl.[7] ..... C22C 38/00

(52) U.S. Cl. ..... 148/320; 428/606

(58) Field of Search ..... 148/320; 428/606

(56) References Cited

U.S. PATENT DOCUMENTS 5,211,772 A * 5/1993 Ashida et al. ..... 148/320
5,575,866 A * 11/1996 Minamida et al. ..... 148/332

FOREIGN PATENT DOCUMENTS

JP 6-100934 * 4/1994 ..... C21D/8/06

* cited by examiner

*Primary Examiner*—Deborah Yee
(74) *Attorney, Agent, or Firm*—Sughrue Mion, PLLC

(57) ABSTRACT

A steel wire for the reinforcement of rubber articles has a diameter of not more than 0.40 mm, a tensile strength of not less than 4000 MPa and number of torsion of not less than 15, and produced by multi-stage wet drawing method with a die having an inner peripheral wall made from a single crystal diamond chip or a sintered diamond chip having a diamond particle size of not less than 10 $\mu$m in at least a final stage.

14 Claims, 6 Drawing Sheets

STEEL WIRE AND METHOD OF PRODUCING THE SAME AND PNEUMATIC TIRE USING THE SAME

BACKGROUND OF THE INVENTION

1. Field of the Invention

This invention relates to a steel wire used as a wire rope, spring, cord for tire or the like, preferably used for the reinforcement of rubber articles, particularly a steel wire having an excellent fatigue resistance and a method of producing the same and a pneumatic tire using the same.

2. Description of Related Art

In general, the steel wires used as a wire rope, spring, cord for tire or the like are required to have various properties. For example, the weight reduction of the tire is urgently needed for recent environmental problems, particularly for promoting low fuel consumption of an automobile, and hence it is required to increase the strength of the steel wire as a starting material for the constituent of the tire to decrease the amount of the steel wire to be used.

In order to increase the strength of the steel wire, there are adopted a method of increasing C content in the steel wire, a method of increasing Mn or Cr content in the steel wire and the like. For example, although a general-purpose steel rod comprising C: 0.79–0.86 mass %, Si: 0.15–0.35 mass % and Mn: 0.30–0.60 mass % such as SWRH82A has been used as a starting material in the conventional steel wire, the use of a steel wire rod comprising C: 0.8–0.9 mass %, Si: 0.1–1.5 mass % and Mn: 0.1–1.0 mass % or a steel rod comprising C: 0.9–1.1 mass %, Si: not more than 0.4 mass %, Mn: not more than 0.5 mass % and Cr: 0.1–0.3 mass % is proposed for the increase of the strength.

However, such a high-strength steel wire is poor in the ductility and causes a problem that the fatigue resistance becomes poor. That is, when products using such a steel wire, particularly tires used under a severe environment are subjected to repetitive bending deformation, particularly when bending input or the like is applied to the steel wire, crack is easily created on the surface of the steel wire to bring about the breakage of the steel wire and hence troubles such as so-called belt breakage, side cut and the like are caused to lower the durability of the tire.

And also, the steel wire rod highly alloyed by increasing the C content or the like is poor in the ductility, so that when such a steel wire rod is drawn to produce steel wire, wire breakage is frequently caused and the production itself becomes difficult.

For this end, the wire breakage has hitherto been avoided by a multi-stage wet drawing method. As shown in FIG. 1, the multi-stage wet drawing method using a die 4 at every stage is effective to avoid the wire breakage during the drawing in a process that a steel wire 3 is alternately extended between driving capstans at each stage in multi-stage driving capstans 2*a*, 2*b* disposed in a lubricating liquid 1.

However, steel wires obtained by such a multi-stage wet drawing method, particularly steel wires obtained by drawing high-carbon steel wire rod having a C content of not less than 0.6 mass % have a problem that when a plurality of such wires are used to produce a steel cord, the wire breakage is frequently caused at a step of twisting these wires.

SUMMARY OF THE INVENTION

It is, therefore, an object of the invention to provide a steel wire simultaneously establishing the increase of the strength and the improvement of fatigue resistance to realize the weight reduction and the improvement of the durability of products using such a steel wire, particularly rubber articles using such a steel wire as a reinforcing member.

It is another object of the invention to provide a drawing method useful for obtaining steel wires having high strength and ductility from high-strength steel wire rod represented by a high-carbon steel wire rod.

According to a first aspect of the invention, there is the provision of a steel wire having a diameter of not more than 0.40 mm, a tensile strength of not less than 4000 MPa and number of torsion of not less than 15.

In a preferable embodiment of the first aspect, the diameter is not more than 0.35 mm and the tensile strength is not less than 4300 MPa, more particularly 4500 MPa.

In another preferable embodiment of the first aspect, the number of torsion is not less than 20.

According to a second aspect of the invention, there is the provision of a method of producing a steel wire as defined in the first aspect of the invention by subjecting a steel wire rod to multi-stage wet drawing, which comprising conducting at least a final stage of the multi-stage wet drawing with a die having an inner peripheral wall made from a single crystal diamond chip or a sintered diamond chip having a diamond particle size of not less than 10 $\mu$m.

In a preferable embodiment of the second aspect, a wire drawing quantity $\epsilon_n$ represented by the following equation is not less than 4.0 at the final stage of the multi-stage wet drawing:

$$\epsilon_n = 2 \cdot \ln(d_0/d_n)$$

wherein $d_0$: diameter of wire rod before the multi-stage wet drawing;

$d_n$: diameter of wire delivered from a die at n-th stage.

In another preferable embodiment of the second aspect, dies having an inner peripheral wall made from a single crystal diamond chip or a sintered diamond chip having a diamond particle size of not less than 10 $\mu$m are used in such stages of the multi-stage wet drawing that a wire drawing quantity $\epsilon_n$ represented by the following equation is not less than 4.0:

$$\epsilon_n = 2 \cdot \ln(d_0/d_n)$$

wherein $d_0$: diameter of wire rod before the multi-stage wet drawing;

$d_n$: diameter of wire delivered from a die at n-th stage.

In the other preferable embodiment of the second aspect, dies having an inner peripheral wall made from a single crystal diamond chip or a sintered diamond chip having a diamond particle size of not less than 10 $\mu$m are used as such dies that a wire drawn out from the die has a tensile strength of not less than 4000 MPa.

In a still further embodiment of the second aspect, the diamond particle size in the sintered diamond chip is not less than 15 $\mu$m.

In a further preferable embodiment of the second aspect, the die has an approach angle of 6–12°, preferably 7–10° and a bearing length corresponding to 30–50% of a diameter of a wire delivered from the die.

In the other preferable embodiment of the second aspect, the steel wire rod has a carbon content of not less than 0.60 mass %, preferably not less than 0.80 mass %.

According to a third aspect of the invention, there is the provision of a pneumatic tire comprising a carcass extending between a pair of bead portions and a belt comprising plural belt layers superimposed on the carcass, characterized in that the steel wire defined in the first aspect of the invention is used as a reinforcing member for the carcass and/or the belt, or a steel cord obtained by twisting a plurality of the steel wires defined in the first aspect of the invention is used as a reinforcing member for the carcass and/or the belt.

BRIEF DESCRIPTION OF THE DRAWINGS

The invention will be described with reference to the accompanying drawings, wherein.

DESCRIPTION OF PREFERRED EMBODIMENTS

The steel wire according to the invention comprises a diameter of not more than 0.40 mm, preferably not more than 0.35 mm, a tensile strength of not less than 4000 MPa, preferably not less than 4300 MPa, more particularly not less than 4500 MPa, and number of torsion of not less than 15, preferably not less than 20.

The reason why the diameter of the steel wire is limited to not more than 0.40 mm is due to the fact that when the steel wire having the diameter of more than 0.40 mm is used as a reinforcing member, the breakage is apt to be easily caused by compression stress.

In general, steel wires having a tensile strength of less than 3700 MPa have been used as a reinforcing member for rubber articles, particularly pneumatic tires. On the contrary, steel wires having a tensile strength fairly higher than the conventional level, concretely tensile strength of not less than 4000 MPa are provided in the invention, so that when such steel wires are applied to, for example, a belt of the tire, it is possible to reduce the amount of the wire used by not less than 20% as compared with the case that the conventional steel wires are applied to the belt under the same tire strength.

In the conventional steel wire, the strength required as the reinforcing member is insured by twisting these wires to form a cord of multi-layer construction or strand construction. In case of using the steel wire according to the invention, the strength is insured even if the number of the wires constituting the cord is reduced, so that it is possible to simplify the construction of the cord and hence the production cost of the cord is largely decreased.

The term "number of torsion" used herein means a numerical value obtained by applying torsion to a steel wire of 100 mm in length under a tension of 1 kgf at 60 rpm to measure a revolution number until the occurrence of crack in the wire and converting the measured revolution number per a length of the wire corresponding to 100 times a diameter of the wire. As the number of torsion becomes higher, the ductility becomes higher.

In the pneumatic tire, the belt breakage, side cut and the like are serious troubles, which are induced by local bending input applied to the steel wire or steel cord as the reinforcing member. Therefore, these troubles can advantageously be avoided when the steel wire as the reinforcing member has the satisfactory ductility.

Figure 2:
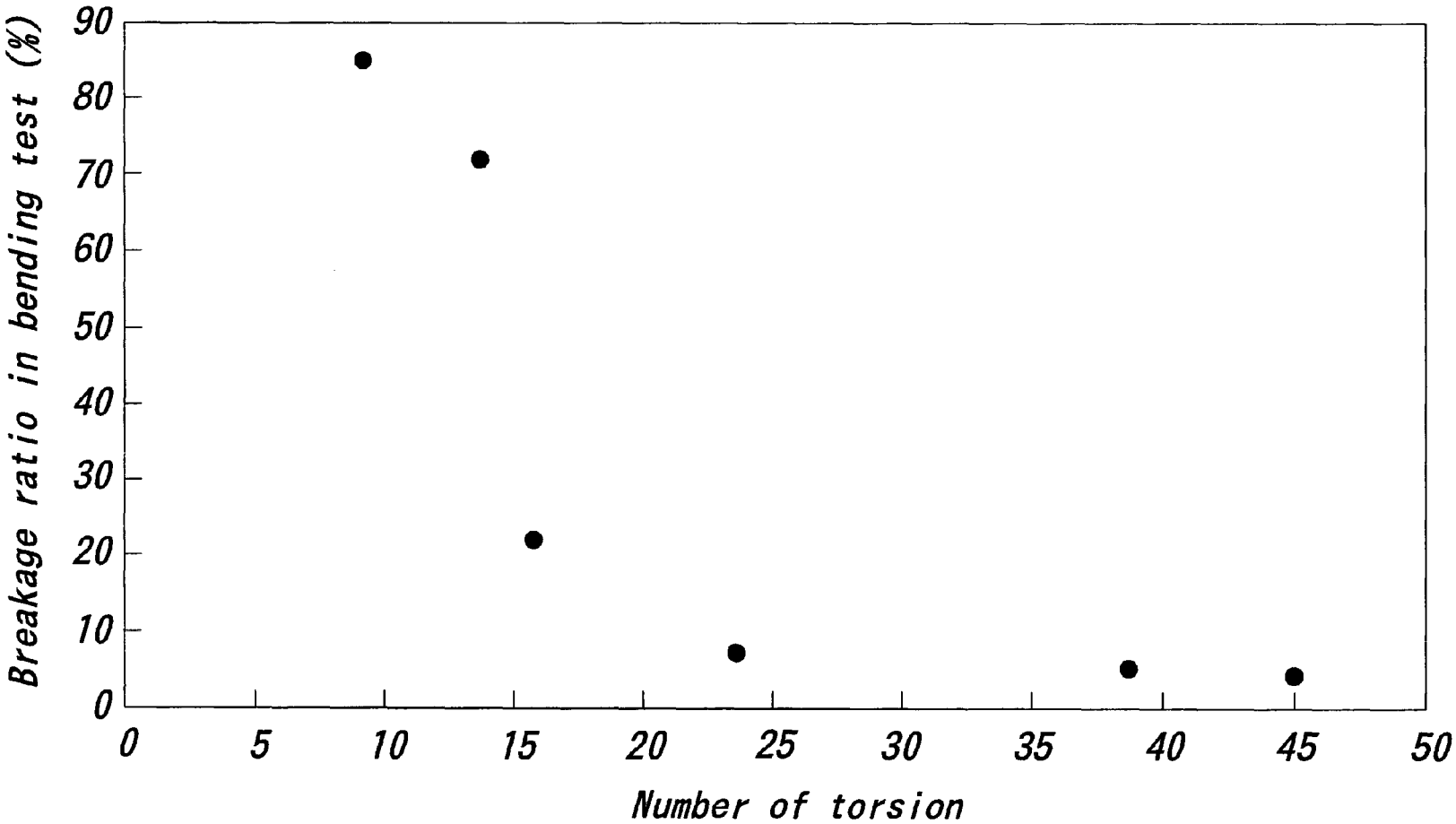
FIG. 2 is a graph showing a relationship between number of torsion in steel wire and breakage ratio in bending test.

In FIG. 2 are shown results investigated on a relationship between the number of torsion and breakage ratio in bending test with respect to the steel wire having a diameter of 0.34 mm and a tensile strength of 4300 MPa. The term "breakage ratio in bending test" used herein means a ratio of causing the breakage when a given number of bending is applied to the steel wire. The smaller the value of the breakage ratio, the better the durability to bending input and it is advantageous to improve the resistance to belt breakage and the resistance to side cut. As seen from FIG. 2, the breakage ratio in the bending test starts to become high when the number of torsion is near to 20 and rapidly increases when the number of torsion is less than 15. In the invention, therefore, the number of torsion in the steel wire is restricted to not less than 15, preferably not less than 20.

The steel wires according to the invention having the above particular properties are produced by a multi-stage wet drawing method as mentioned later.

In the conventional multi-stage wet drawing, a super-hard alloy such as WC—Co alloy or the like, or a diamond sintered body having a relatively small diamond particle size is used as a chip constituting an inner peripheral wall of a die. However, when using the chip of the super-hard alloy or diamond sintered body, the friction coefficient between wire rod and die chip becomes high and the pulling force in the drawing becomes large and hence brittleness is caused due to abnormal hardening of the wire rod surface resulted from heat generation and the sufficient ductility is not obtained and the wire breaking is brought at subsequent drawing step or twisting step. Particularly, the above wire breaking is apt to be caused when the steel wire having a diameter of not more than 40 mm is produced from a steel wire rod containing not less than 0.60 mass % of carbon.

Figure 1:
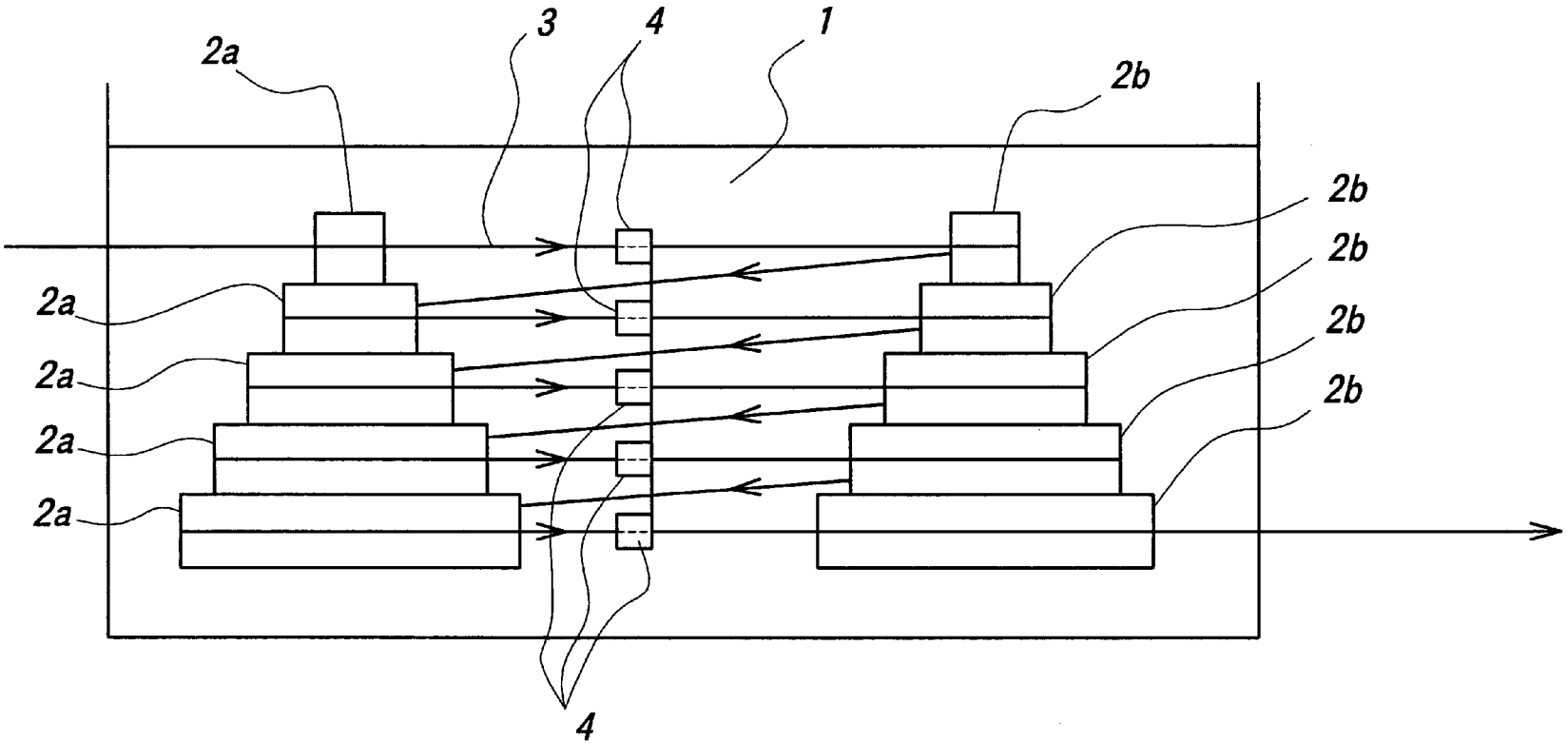
FIG. 1 is a schematic view illustrating a multi-stage slip type wet drawing.

In the invention, therefore, at least a final stage of the multi-stage wet drawing shown in FIG. 1 is carried out by using a die having an inner peripheral wall made from a single crystal diamond chip or a sintered diamond chip having a diamond particle size of not less than 10 $\mu$m, whereby the ductility of the resulting steel wire is improved.

Figure 3A:
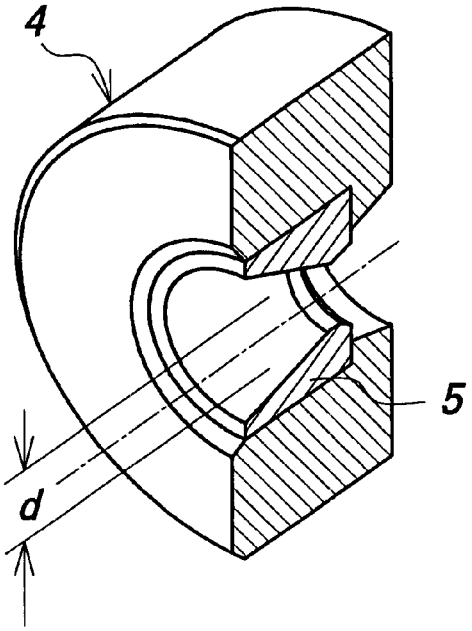
FIG. 3*a* is a partially cutaway view in perspective of a die.
Figure 3B:
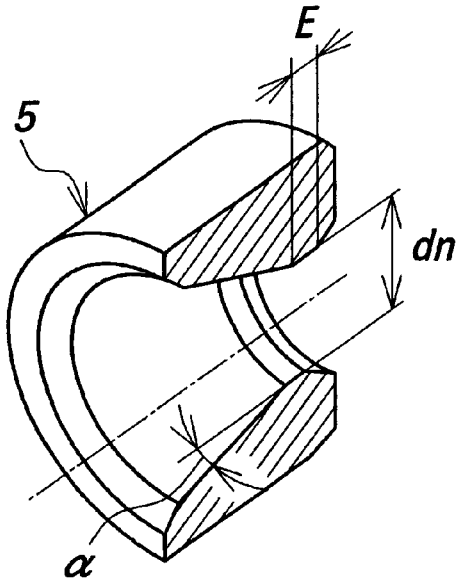
FIG. 3*b* is a partially cutaway view in perspective of a chip used in the die.

As shown in FIGS. 3*a* and 3*b*, the single crystal diamond chip or the sintered diamond chip having a diamond particle size of not less than 10 $\mu$m, preferably not less than 15 $\mu$m is used in a chip 5 constituting an inner peripheral wall of a die 4, whereby the friction coefficient of an inner peripheral face of the chip 5 is lowered to reduce heat generation in the drawing and avoid brittleness of wire rod surface in the drawing and prevent the degradation of ductility in the resulting steel wire.

Moreover, the upper limit of the diamond particle size in the sintered diamond chip is preferably 30 $\mu$m, more particularly 25 $\mu$m. When the diamond particle size exceeds the upper limit, the remarkable effect is not obtained with the increase of cost and the chip becomes too brittle.

Figure 4:
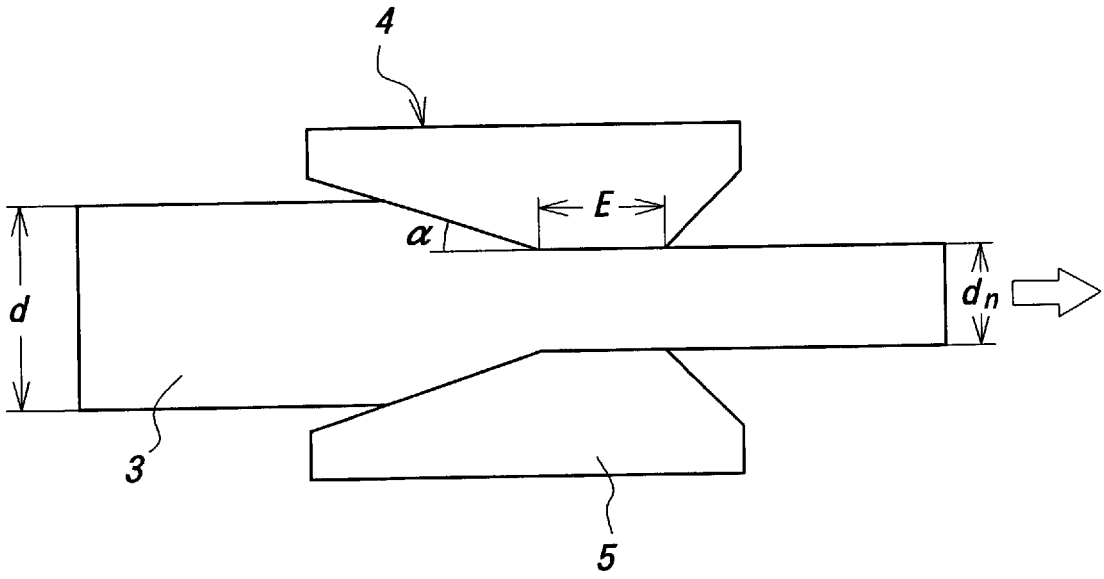
FIG. 4 is a diagrammatic view of a die in the drawing.

In the invention, it is favorable that a wire drawing quantity $\epsilon_n$ represented by the following equation (1) is not less than 4.0 at the final stage of the multi-stage wet drawing:

$$\epsilon_n = 2 \cdot \ln(d_0/d_n) \quad (1)$$

wherein $d_0$: diameter of wire rod before the multi-stage wet drawing;

$d_n$: diameter of wire delivered from a die at n-th stage as shown in FIG. 4.

When the wire drawing quantity $\epsilon_n$ at the final stage is not less than 4.0, the tensile strength of the resulting steel wire becomes higher and the heat generation in the drawing and frictional heat due to the contact between the die and the wire rod are very high, which are effectively controlled by using the chip comprised of the above material. Moreover, when the wire drawing quantity $\epsilon_n$ is less than 4.0, the effect by the use of the above chip becomes small.

The ductility of the steel wire is effectively improved by applying the die provided with the single crystal diamond chip or the sintered diamond chip having a diamond particle size of not less than 10 $\mu$m to at least a final stage which generates especially high heat. More preferably, when such a die is used as a die at each of stages of the multi-stage wet drawing that the wire drawing quantity $\epsilon_n$ is not less than 4.0 or a die that the tensile strength of the wire drawn out from the die is not less than 4000 MPa, it is effective to avoid the wire breaking in the drawing in addition to the improvement of the ductility in the steel wire.

Furthermore, the invention aims at the production of steel wires having a tensile strength of not less than 4000 MPa and number of torsion of not less than 15 from a high carbon steel wire rod containing not less than 0.8 mass % of carbon, which has hardly been drawn in the conventional technique. In this case, it is effective to render the chip into an adequate shape in addition to the above improvement of the material in the die chip.

That is, it is important that at least a die provided with the single crystal diamond chip or the sintered diamond chip having a diamond particle size of not less than 10 $\mu$m has an approach angle $\alpha$ of 6–12°, preferably 7–10° and a bearing length E corresponding to 30–50% of a diameter $d_n$ of the wire drawn out as shown in FIGS. 3 and 4.

When the approach angle $\alpha$ in the die chip is less than 6°, the contact length with the wire rod in the approach becomes longer and heat generation through friction increases and hence the sufficient ductility can not be obtained, while when it exceeds 12°, the pulling resistance becomes higher and there is a risk of inducing the wire breaking in the drawing.

When the bearing length E in the die chip is less than 30% of the delivered wire diameter $d_n$, the sufficient straightness can not be given to the resulting steel wire and there is a possibility of badly affecting the twisting properties in the formation of cords or quality of the cord such as straightness or the like, while when it exceeds 50% of the delivered wire diameter $d_n$, the contact length between the bearing and the wire rod becomes longer and heat generation through friction increases and hence the sufficient ductility can not be obtained.

Moreover, when the steel wire 3 is extended between a pair of driving capstans 2*a*, 2*b* at each stage among multi-stage driving capstans disposed in a lubricating liquid 1 as shown in FIG. 1, it is favorable that the peripheral surface of each capstan 2*a*, 2*b* winding the steel wire 3 is made smooth and concretely has an arithmetically average roughness of less than 0.2 $\mu$m, preferably less than 0.1 $\mu$m to thereby reduce friction between the wire and the capstan.

Figure 5:
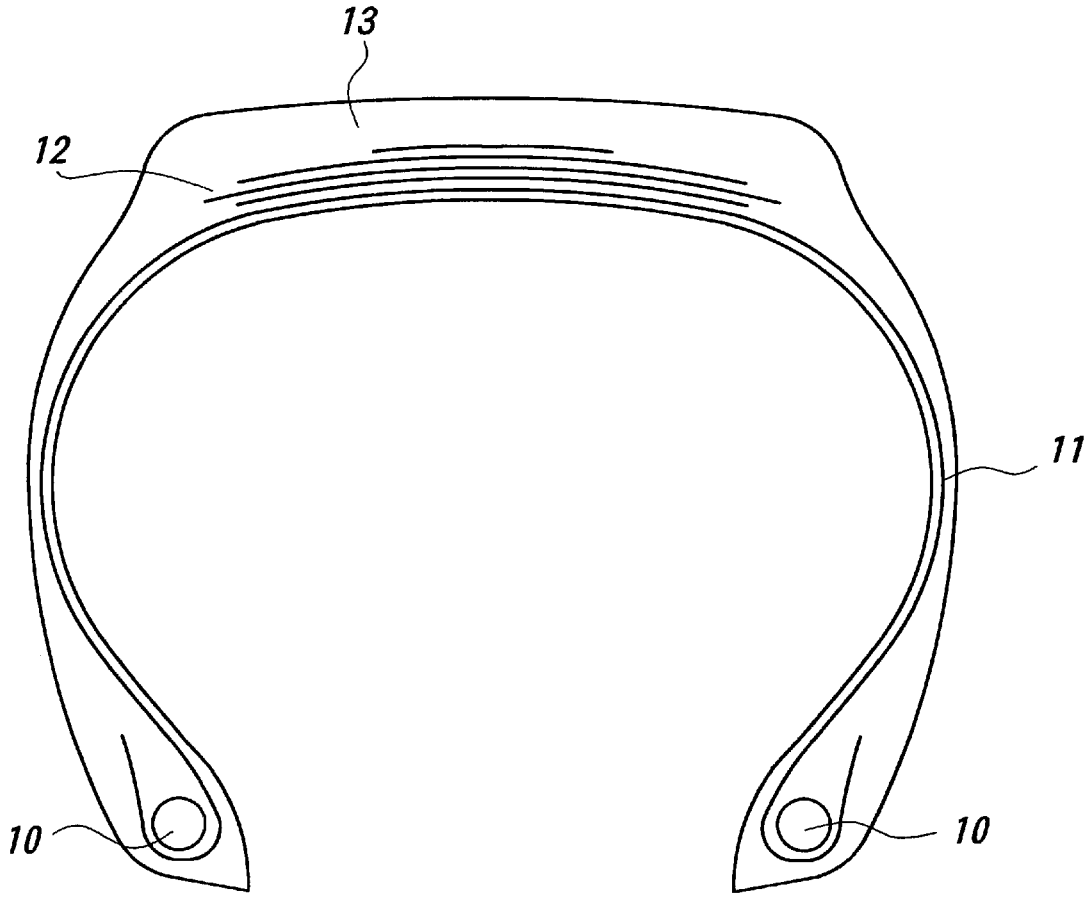
FIG. 5 is a diagrammatically section view of an embodiment of the pneumatic tire according to the invention.
Figure 6:
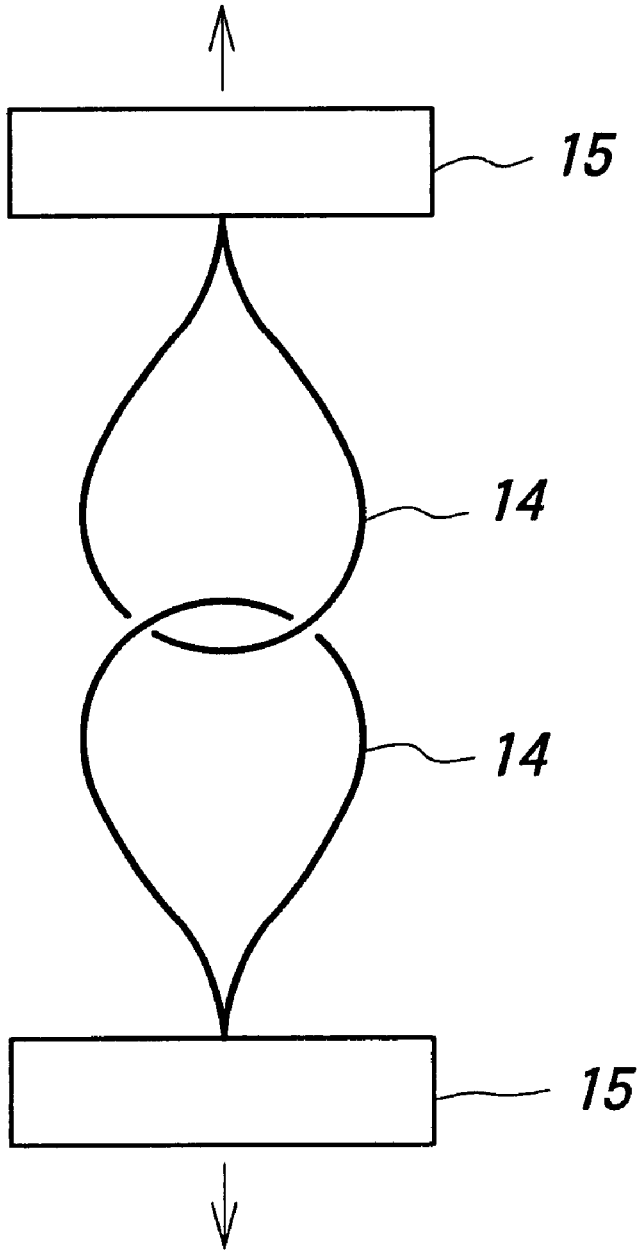
FIG. 6 is a diagrammatic view illustrating the measurement on a loop strength of a steel wire.

Further, the invention provides a pneumatic tire using the above steel wire as a reinforcing member for a belt and/or a carcass. In this case, the steel wires or cords formed by twisting a plurality of these steel wires are arranged in parallel to each other and embedded in a coating rubber to form a ply. Moreover, the structure of the tire may follow to that of the existing pneumatic tire for truck and bus. For example, there is advantageously adapted a tire shown in FIG. 5.

The illustrated tire comprises a carcass 11 toroidally extending between a pair of bead cores 10 and containing cords arranged in a radial direction of the tire, a belt 12 superimposed on the carcass 11 and comprised of 3–4 belt layers, four belt layers in the illustrated embodiment, and a tread 13 disposed on the belt 12.

The belt 12 has a structure that the belt layers containing many steel wires or cords preferably arranged at a cord inclination angle of 20–75° with respect to the ply cord of the carcass 11 are piled one upon the other so as to cross the wires or cords of these layers with each other.

The following examples are given in illustration of the invention and are not intended as limitations thereof.

There are provided a wire rod obtained by subjecting a high carbon steel wire rod having a carbon content of 0.90 mass % and a diameter of 5.5 mm to dry drawing to a diameter of about 1.29 mm and then to patenting and brass plating treatments, and a wire rod obtained by subjecting a high carbon steel wire rod having a carbon content of 0.80 mass % and a diameter of 5.5 mm to dry drawing to a diameter of about 1.10 mm and then to patenting and brass plating treatments. Thereafter, each of these wire rods is subjected to multi-stage slip type wet drawing as shown in FIG. 1 under conditions shown in Tables 1–4 to produce a steel wire having a diameter of 0.16 mm.

TABLE 1

Example 1

| | Die | | | | | | | |
|---|---|---|---|---|---|---|---|---|
| | Entered wire diameter (mm) | Delivered wire diameter (mm) | Reduction of area (%) | Material of chip | Approach angle $\alpha$ | Bearing length E * | Wire drawing quantity $\epsilon_n$ | Tensile strength of steel wire (MPa) |
| 1 | 1.290 | 1.260 | 4.6 | WC | 9° | 50% | 0.05 | 1448 |
| 2 | 1.260 | 1.200 | 9.3 | | 9° | 50% | 0.14 | 1500 |
| 3 | 1.200 | 1.090 | 17.5 | | 9° | 50% | 0.34 | 1568 |
| 4 | 1.090 | 0.970 | 20.8 | | 9° | 50% | 0.57 | 1671 |
| 5 | 0.970 | 0.860 | 21.4 | | 9° | 50% | 0.81 | 1754 |
| 6 | 0.860 | 0.765 | 20.9 | | 9° | 50% | 1.05 | 1858 |
| 7 | 0.765 | 0.680 | 21.0 | | 9° | 50% | 1.28 | 1974 |
| 8 | 0.680 | 0.605 | 20.8 | | 9° | 50% | 1.51 | 2101 |
| 9 | 0.605 | 0.540 | 20.3 | | 9° | 50% | 1.74 | 2237 |
| 10 | 0.540 | 0.480 | 21.0 | | 9° | 50% | 1.98 | 2392 |
| 11 | 0.480 | 0.425 | 21.6 | | 9° | 50% | 2.22 | 2566 |

TABLE 1-continued

| | Example 1 | | | | | | | |
|---|---|---|---|---|---|---|---|---|
| | Die | | | | | | | |
| | Entered wire diameter (mm) | Delivered wire diameter (mm) | Reduction of area (%) | Material of chip | Approach angle α | Bearing length E * | Wire drawing quantity $\epsilon_n$ | Tensile strength of steel wire (MPa) |
| 12 | 0.425 | 0.380 | 20.1 | | 9° | 50% | 2.44 | 2739 |
| 13 | 0.380 | 0.340 | 19.9 | | 9° | 50% | 2.67 | 2924 |
| 14 | 0.340 | 0.305 | 19.5 | | 9° | 50% | 2.88 | 3116 |
| 15 | 0.305 | 0.275 | 18.7 | | 9° | 50% | 3.09 | 3310 |
| 16 | 0.275 | 0.253 | 15.4 | | 9° | 50% | 3.26 | 3475 |
| 17 | 0.253 | 0.232 | 15.9 | Single | 9° | 50% | 3.43 | 3653 |
| 18 | 0.232 | 0.214 | 14.9 | crystal | 9° | 50% | 3.59 | 3826 |
| 19 | 0.214 | 0.198 | 14.4 | diamond | 9° | 50% | 3.75 | 3999 |
| 20 | 0.198 | 0.185 | 12.7 | | 9° | 50% | 3.88 | 4154 |
| 21 | 0.185 | 0.174 | 11.5 | | 9° | 50% | 4.01 | 4300 |
| 22 | 0.174 | 0.165 | 10.1 | | 9° | 50% | 4.11 | 4429 |
| 23 | 0.165 | 0.160 | 6.0 | | 9° | 50% | 4.17 | 4510 |

* : ratio to delivered wire diameter $d_n$

TABLE 2

| | Example 2 | | | | | | | |
|---|---|---|---|---|---|---|---|---|
| | Die | | | | | | | |
| | Entered wire diameter (mm) | Delivered wire diameter (mm) | Reduction of area (%) | Material of chip | Approach angle α | Bearing length E * | Wire drawing quantity $\epsilon_n$ | Tensile strength of steel wire (MPa) |
| 1 | 1.290 | 1.260 | 4.6 | WC | 9° | 50% | 0.05 | 1448 |
| 2 | 1.260 | 1.200 | 9.3 | | 9° | 50% | 0.14 | 1500 |
| 3 | 1.200 | 1.090 | 17.5 | | 9° | 50% | 0.34 | 1568 |
| 4 | 1.090 | 0.970 | 20.8 | | 9° | 50% | 0.57 | 1671 |
| 5 | 0.970 | 0.860 | 21.4 | | 9° | 50% | 0.81 | 1754 |
| 6 | 0.860 | 0.765 | 20.9 | | 9° | 50% | 1.05 | 1858 |
| 7 | 0.765 | 0.680 | 21.0 | | 9° | 50% | 1.28 | 1974 |
| 8 | 0.680 | 0.605 | 20.8 | | 9° | 50% | 1.51 | 2101 |
| 9 | 0.605 | 0.540 | 20.3 | | 9° | 50% | 1.74 | 2237 |
| 10 | 0.540 | 0.480 | 21.0 | | 9° | 50% | 1.98 | 2392 |
| 11 | 0.480 | 0.425 | 21.6 | | 9° | 50% | 2.22 | 2566 |
| 12 | 0.425 | 0.380 | 20.1 | | 9° | 50% | 2.44 | 2739 |
| 13 | 0.380 | 0.340 | 19.9 | | 9° | 50% | 2.67 | 2924 |
| 14 | 0.340 | 0.305 | 19.5 | | 9° | 50% | 2.88 | 3116 |
| 15 | 0.305 | 0.275 | 18.7 | | 9° | 50% | 3.09 | 3310 |
| 16 | 0.275 | 0.253 | 15.4 | | 9° | 50% | 3.26 | 3475 |
| 17 | 0.253 | 0.232 | 15.9 | Diamond | 9° | 50% | 3.43 | 3653 |
| 18 | 0.232 | 0.214 | 14.9 | having a | 9° | 50% | 3.59 | 3826 |
| 19 | 0.214 | 0.198 | 14.4 | particle | 9° | 50% | 3.75 | 3999 |
| 20 | 0.198 | 0.185 | 12.7 | size of | 9° | 50% | 3.88 | 4154 |
| 21 | 0.185 | 0.174 | 11.5 | not less | 9° | 50% | 4.01 | 4300 |
| 22 | 0.174 | 0.165 | 10.1 | than | 9° | 50% | 4.11 | 4429 |
| 23 | 0.165 | 0.160 | 6.0 | 20 μm | 9° | 50% | 4.17 | 4510 |

* : ratio to delivered wire diameter $d_n$

TABLE 3

| | Conventional Example 1 | | | | | | | |
|---|---|---|---|---|---|---|---|---|
| | Die | | | | | | | |
| | Entered wire diameter (mm) | Delivered wire diameter (mm) | Reduction of area (%) | Material of chip | Approach angle α | Bearing length E * | Wire drawing quantity $\epsilon_n$ | Tensile strength of steel wire (MPa) |
| 1 | 1.290 | 1.2605 | 4.6 | WC | 9° | 50% | 0.05 | 1448 |
| 2 | 1.260 | 1.200 | 9.3 | | 9° | 50% | 0.14 | 1500 |
| 3 | 1.200 | 1.090 | 17.5 | | 9° | 50% | 0.34 | 1568 |
| 4 | 1.090 | 0.970 | 20.8 | | 9° | 50% | 0.57 | 1671 |

TABLE 3-continued

| | Conventional Example 1 | | | | | | | |
|---|---|---|---|---|---|---|---|---|
| | Die | | | | | | | |
| | Entered wire diameter (mm) | Delivered wire diameter (mm) | Reduction of area (%) | Material of chip | Approach angle α | Bearing length E * | Wire drawing quantity $\epsilon_n$ | Tensile strength of steel wire (MPa) |
| 5 | 0.970 | 0.860 | 21.4 | | 9° | 50% | 0.81 | 1754 |
| 6 | 0.860 | 0.765 | 20.9 | | 9° | 50% | 1.05 | 1858 |
| 7 | 0.765 | 0.680 | 21.0 | | 9° | 50% | 1.28 | 1974 |
| 8 | 0.680 | 0.605 | 20.8 | | 9° | 50% | 1.51 | 2101 |
| 9 | 0.605 | 0.540 | 20.3 | | 9° | 50% | 1.74 | 2237 |
| 10 | 0.540 | 0.480 | 21.0 | | 9° | 50% | 1.98 | 2392 |
| 11 | 0.480 | 0.425 | 21.6 | | 9° | 50% | 2.22 | 2566 |
| 12 | 0.425 | 0.380 | 20.1 | | 9° | 50% | 2.44 | 2739 |
| 13 | 0.380 | 0.340 | 19.9 | | 9° | 50% | 2.67 | 2924 |
| 14 | 0.340 | 0.305 | 19.5 | | 9° | 50% | 2.88 | 3116 |
| 15 | 0.305 | 0.275 | 18.7 | | 9° | 50% | 3.09 | 3310 |
| 16 | 0.275 | 0.253 | 15.4 | | 9° | 50% | 3.26 | 3475 |
| 17 | 0.253 | 0.232 | 15.9 | | 9° | 50% | 3.43 | 3653 |
| 18 | 0.232 | 0.214 | 14.9 | | 9° | 50% | 3.59 | 3826 |
| 19 | 0.214 | 0.198 | 14.4 | | 9° | 50% | 3.75 | 3999 |
| 20 | 0.198 | 0.185 | 12.7 | | 9° | 50% | 3.88 | 4154 |
| 21 | 0.185 | 0.174 | 11.5 | | 9° | 50% | 4.01 | 4300 |
| 22 | 0.174 | 0.165 | 10.1 | | 9° | 50% | 4.11 | 4429 |
| 23 | 0.165 | 0.160 | 6.0 | | 9° | 50% | 4.17 | 4510 |

* : ratio to delivered wire diameter $d_n$

TABLE 4

| | Conventional Example 2 | | | | | | | |
|---|---|---|---|---|---|---|---|---|
| | Die | | | | | | | |
| | Entered wire diameter (mm) | Delivered wire diameter (mm) | Reduction of area (%) | Material of chip | Approach angle α | Bearing length E * | Wire drawing quantity $\epsilon_n$ | Tensile strength of steel wire (MPa) |
| 1 | 1.100 | 1.080 | 3.6 | WC | 9° | 50% | 0.04 | 1274 |
| 2 | 1.080 | 1.020 | 10.8 | | 9° | 50% | 0.15 | 1338 |
| 3 | 1.020 | 0.930 | 16.9 | | 9° | 50% | 0.34 | 1418 |
| 4 | 0.930 | 0.825 | 21.3 | | 9° | 50% | 0.58 | 1500 |
| 5 | 0.825 | 0.735 | 20.6 | | 9° | 50% | 0.81 | 1571 |
| 6 | 0.735 | 0.655 | 20.6 | | 9° | 50% | 1.04 | 1663 |
| 7 | 0.655 | 0.585 | 20.2 | | 9° | 50% | 1.26 | 1762 |
| 8 | 0.585 | 0.520 | 21.0 | | 9° | 50% | 1.50 | 1876 |
| 9 | 0.520 | 0.465 | 20.0 | | 9° | 50% | 1.72 | 1995 |
| 10 | 0.465 | 0.415 | 20.3 | | 9° | 50% | 1.95 | 2127 |
| 11 | 0.415 | 0.370 | 20.5 | | 9° | 50% | 2.18 | 2273 |
| 12 | 0.370 | 0.335 | 18.0 | | 9° | 50% | 2.38 | 2408 |
| 13 | 0.335 | 0.305 | 17.1 | | 9° | 50% | 2.57 | 2544 |
| 14 | 0.305 | 0.280 | 15.7 | | 9° | 50% | 2.74 | 2675 |
| 15 | 0.280 | 0.255 | 17.1 | | 9° | 50% | 2.92 | 2826 |
| 16 | 0.255 | 0.235 | 15.1 | | 9° | 50% | 3.09 | 2964 |
| 17 | 0.235 | 0.215 | 16.3 | | 9° | 50% | 3.26 | 3122 |
| 18 | 0.215 | 0.200 | 13.5 | | 9° | 50% | 3.41 | 3255 |
| 19 | 0.200 | 0.186 | 13.5 | | 9° | 50% | 3.55 | 3390 |
| 20 | 0.186 | 0.175 | 11.5 | | 9° | 50% | 3.68 | 3510 |
| 21 | 0.175 | 0.165 | 11.1 | | 9° | 50% | 3.79 | 3625 |
| 22 | 0.165 | 0.160 | 6.0 | | 9° | 50% | 3.86 | 3680 |

* : ratio to delivered wire diameter $d_n$

With respect to the thus obtained steel wires, the tensile strength, number of torsion, breakage ratio in bending test and retention of loop strength are measured to obtain results as shown in Table 5. Moreover, the retention of loop strength is measured by hanging two steel wires 14 with each other in a loop form and fixing them to centers of clips 15 of a tensile testing machine so as to contact both end portions of each of the wires 14 in parallel to each other and holding hanged portions of the wires 14 at a shape of constant curvature and actuating the tensile testing machine to separate away the clips 15 from each other to measure a load at the breakage of the wire 14 as a loop strength, and represented by a percentage of loop strength/tensile strength. As seen from the results of Table 5, the steel wires according to the invention have excellent properties.

TABLE 5

| | Example 1 | Example 2 | Conventional Example 1 | Conventional Example 2 |
|---|---|---|---|---|
| Tensile strength (MPa) | 4510 | 4510 | 4510 | 3680 |
| Number of torsion | 19.9 | 18.6 | 2.4 | 31.8 |
| Breakage ratio in bending test (%) | 9 | 10 | 85 | 6 |
| Retention of loop strength (%) | 73 | 72 | 41 | 79 |

Then, the frequency of wire breaking when the steel wires are twisted into a steel cord of 3+9×0.16 (mm) construction is measured with respect to the amount of cords actually produced to obtain results as shown in Table 6, in which the frequency is represented by an index on the basis that Conventional Example 1 is 100. As seen from the results of Table 6, the frequency of wire breaking in the twisting is considerably lowered by using the steel wire according to the invention.

TABLE 6

| | Example 1 | Example 2 | Conventional Example 1 | Conventional Example 2 |
|---|---|---|---|---|
| Frequency of wire breaking in twisting | 30 | 35 | 100 | 10 |

As mentioned above, according to the invention, there can be provided steel wires simultaneously having high strength and high ductility. Therefore, it is possible to reduce the weight of a product such as a rubber article using such a steel wire or a steel cord made from the steel wire as a reinforcing member and improve the durability of such a product.

What is claimed is:

1. A steel wire having a carbon content of 0.60 mass % to 1.1 mass %, a diameter of not more than 0.40 mm, a tensile strength of not less than 4300 MPa and number of torsion of not less than 15.

2. A steel wire according to claim 1, wherein the diameter is not more than 0.35 mm.

3. A steel wire according to claim 2, wherein the tensile strength is not less than 4500 MPa.

4. A steel wire according to claim 1, wherein the number of torsion is not less than 20.

5. A method of producing a steel wire as claimed in claim 1 by subjecting a steel wire rod to multi-stage wet drawing, which method comprising conducting at least a final stage of the multi-stage wet drawing with a die having an inner peripheral wall made from a single crystal diamond chip or a sintered diamond chip having a diamond particle size of not less than 10 $\mu$m.

6. The method according to claim 5, wherein a wire drawing quantity $\epsilon_n$ represented by the following equation is not less than 4.0 at the final stage of the multi-stage wet drawing:

$$\epsilon_n = \text{In}(d_o/d_n)$$

wherein $d_o$: diameter of wire rod before the multi-stage wet drawing;

$d_n$: diameter of wire delivered from a die at n-th stage.

7. The method according to claim 5, wherein dies having an inner peripheral wall made from a single crystal diamond chip or a sintered diamond chip having a diamond particle size of not less than 10 $\mu$m are used in such stages of the multi-stage wet drawing that a wire drawing quantity $\epsilon_n$ represented by the following equation is not less than 4.0:

$$\epsilon_n = \text{In}(d_o/d_n)$$

wherein do: diameter of wire rod before the multi-stage wet drawing;

$d_n$: diameter of wire delivered from a die at n-th stage.

8. The method according to claim 5 wherein dies having an inner peripheral wall made from a single crystal diamond chip or a sintered diamond chip having a diamond particle size of not less than 10 $\mu$m are used as such dies that a wire drawn out from the die has a tensile strength of not less than 4000 MPa.

9. The method according to claim 5, wherein the diamond particle size in the sintered diamond chip is not less than 15 $\mu$m.

10. The method according to claim 5, wherein the die has an approach angle of 6–12° and a bearing length corresponding to 30–50% of a diameter of a wire drawn out from the die.

11. The method according to claim 10, wherein the approach angle is 7–10°.

12. The method according to claim 5, wherein the steel wire rod has a carbon content of not less than 0.60 mass %.

13. The method according to claim 12, wherein the carbon content is not less than 0.80 mass %.

14. A pneumatic tire comprising a carcass extending between a pair of bead portions and a belt comprising plural belt layers superimposed on the carcass, characterized in that the steel wire as claimed in claim 1 is used as a reinforcing member for the carcass and/or the belt, or a steel cord obtained b twisting a plurality of the steel wires as claimed in claim 1 is used as a reinforcing member for die carcass and/or the belt.

* * * * *